US005605016A

United States Patent [19]

Pollard

[11] Patent Number: 5,605,016

[45] Date of Patent: Feb. 25, 1997

[54] ADJUSTABLE POCKET DOOR TRACK

[76] Inventor: Albert C. Pollard, P.O. Box 266, Irvington, Va. 22480

[21] Appl. No.: 494,592

[22] Filed: Jun. 23, 1995

Related U.S. Application Data

[62] Division of Ser. No. 298,408, Aug. 30, 1994, abandoned.

[51] Int. Cl.[6] ..... E06B 3/00

[52] U.S. Cl. ..... 49/506; 49/409

[58] Field of Search ..... 49/409, 506; 16/94 R, 16/95 R, 96 R, 105; 29/525.1

[56] References Cited

U.S. PATENT DOCUMENTS

| | | | |
|---|---|---|---|
| 357,969 | 2/1887 | Stevens | 16/96 R |
| 1,228,327 | 5/1917 | Kohler | 16/94 R |
| 3,152,354 | 10/1964 | Diack | 16/94 R |
| 4,031,664 | 6/1977 | Wendt | 49/409 |
| 4,084,289 | 4/1978 | Naimo | 16/96 R |
| 5,263,594 | 11/1993 | Bianchi | 16/96 R X |

*Primary Examiner*—Kenneth J. Dorner
*Assistant Examiner*—Jerry Redman

[57] ABSTRACT

A pocket door track assembly having a track with an adjustment to angle up or down the portion of the track over the doorway indepedently of a fixed portion of the track in the door pocket. The track has a flexible center portion enabling adjustment of the hanging position of the door when closed independent of the hanging position of the door when open. An adjustment screw is used to raise or lower one end of the track.

1 Claim, 3 Drawing Sheets

ADJUSTABLE POCKET DOOR TRACK

This application is a divisional application of Ser. No. 08/298,408 filed on Aug. 30, 1994 now abandoned.

FIELD OF INVENTION

The invention relates to sliding pocket doors, more particularly to a means of adjusting independently the vertical handing position of the door when closed from adjustment of the hanging position of the door when open.

BACKGROUND OF INVENTION

Pocket doors are doors, most commonly used in residential construction, which slide on a track into a pocket within a wall. When open, the door is within the wall pocket. Closing the door is performed by sliding the door out of the pocket in the wall across a doorway opening. The most common construction of pocket doors uses a track fastened at the top of the door opening. An assembly with rollers rides in the track and the door is suspended from this roller assembly. The track across the top of the door opening extends into the wall pocket. In operation, the door suspended from the roller assembly is free to move in and out of the pocket, to close and open the door.

When the door is fully open, that is in the wall pocket, the edge of the door should be flush with the pocket opening the full height of the door, top to bottom. Likewise, when the door is closed, that is the door is suspended from the track in the doorway, the edge of the door should neatly fit against the door jamb, top to bottom. These two conditions, having the edge of the door flush with the pocket opening when the door is open, and having the edge of the door neatly fit against the jamb when the door is closed, must be met for a neat installation. Means of adjustment are provided where the door is suspended from the rollers to facilitate meeting these two conditions.

However, frequently in installation, it is not possible to meet these two conditions by means of adjusting the suspension of the door from the rollers. In other words, if the suspension of the door is adjusted so that the edge of the door is flush with the pocket, the door may not be in proper adjustment when the door is closed. There are a number of factors that can lead to the this problem. For example, if the track is not straight, that is, if the track sags in the middle, the edge of the door will not remain exactly vertical throughout its travel as the door is closed. Another problem results when the two sides of the door opening, i.e. the pocket and the jamb are not parallel.

Pocket doors are difficult to install in a manner which does not lead to the problems discussed above. The difficulty is compounded by the fact that a framing crew usually installs the track and a separate finish or trim crew installs the door. Framing crews are typically not accustom to the precision work required in installing the track and frequently not held accountable for the difficulty presented to the trim crew. Heretofore, in practice, the only way to correct these problems has been to remove and reinstall the door jamb and trim.

OBJECTS OF THE INVENTION

An object of the invention is to provide simple and inexpensive means to adjust the suspension of a pocket door.

Additional objects, advantages and novel features will become apparent upon examination of the following and will be learned through use of the invention.

SUMMARY OF INVENTION

According to the present invention, the foregoing and other objects are attained by an adjustment to the track. The track adjustment adjust the position of the half of the track above the doorway independently of the position of the half of the track in the door pocket. The adjustment is accomplished by a somewhat flexible center portion of track between the half in the door pocket and the half above the doorway. This flexible portion provides a hinge action in the center of the track. The portion of the track in the door pocket is rigidly fixed in place. Whereas, the portion of the track above the door opening is free to move slightly so that it is angled up or down relative to the fixed portion fixed in the pocket. A means, such as a screw, is used to adjust the angle of the movable portion of the track. To use the adjustable track, the door is first adjusted to hang properly in the open position by means of adjustments on it's suspension from the rollers on the track, the door is then adjusted so that the door hangs properly in the closed position by adjusting the angle of the portion of the track over the door opening. The adjustable track thus provides an adjustment for the suspension of door in the closed position which is independent of the adjustment made when the door is in the open position.

PREFERRED EMBODIMENT

Figure 1:
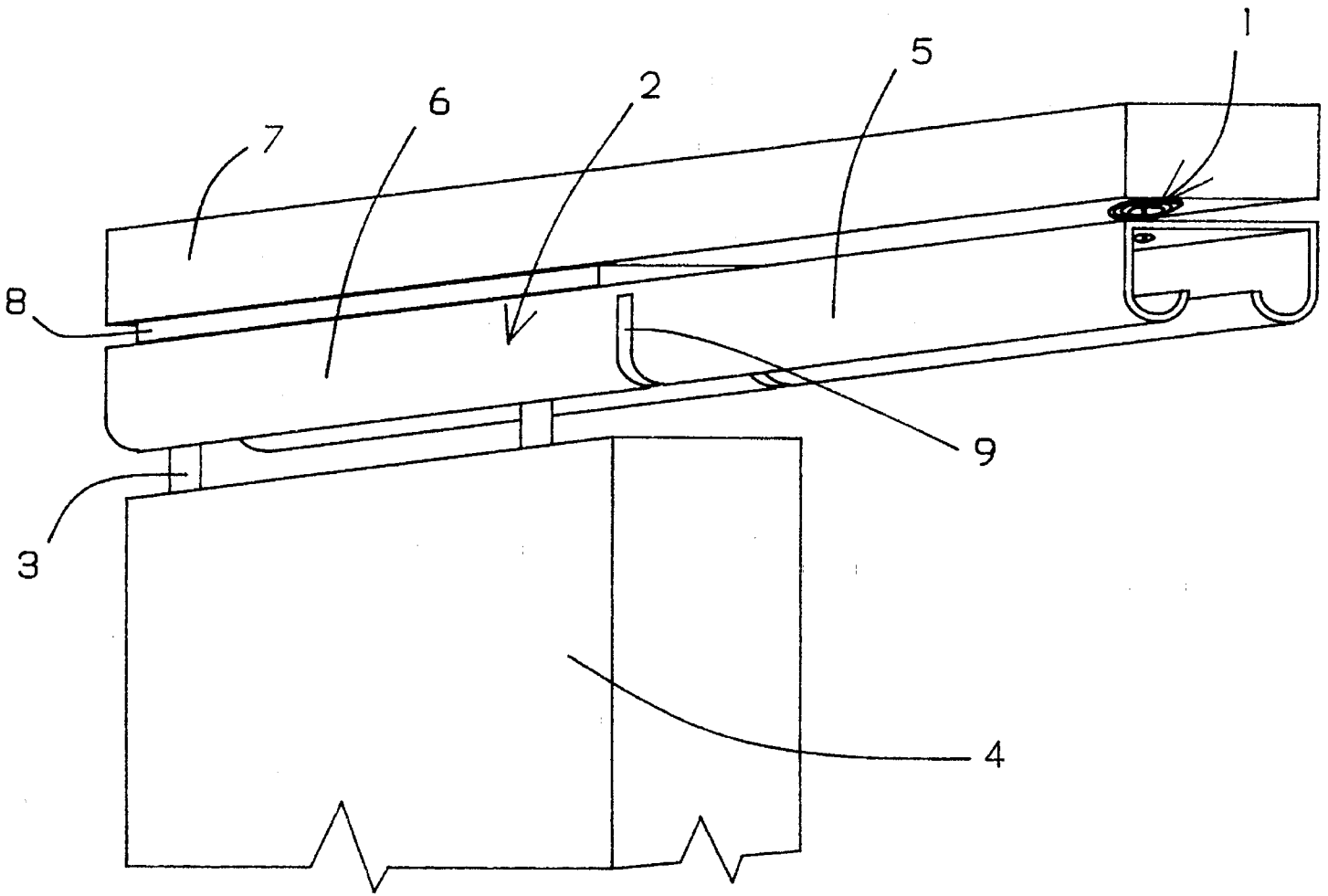
FIG. 1 is a perspective view of the adjustable track.

Throughout the following discussion reference numerals have the meaning in the following list. This list is provided to facilitate understanding of the drawings.

1. Adjustment mechanism as detailed in FIG. 2.
2. Track referring to entire track.
3. Adjustable suspension.
4. Door.
5. Track doorway segment.
6. Track pocket segment.
5. Head member.
8. Spacer.
9. Relief slit.
10. Screw.
11. Spring.
12. Spring opening.
13. Threaded insert.
14. Hole in track.
15. Opening in head member.

Figure 2:
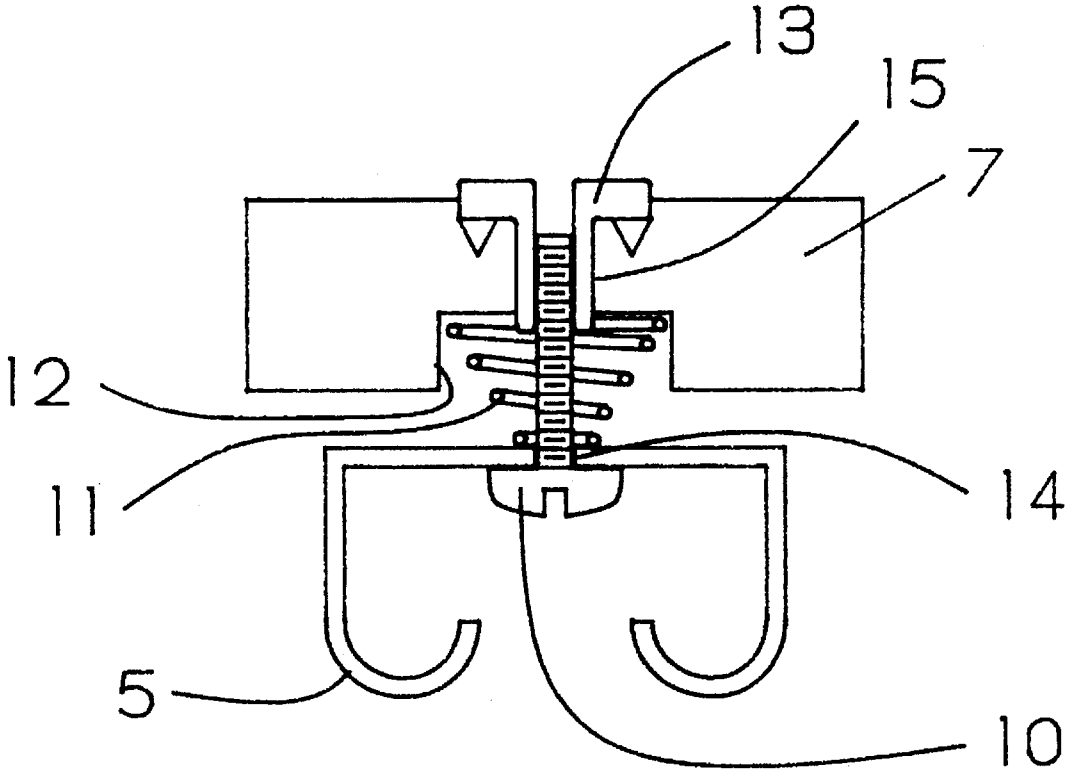
FIG. 2 is a section through the adjustment mechanism 1 taken in a vertical plane perpendicular to the axis of the track.

FIG. 1 provides an overview of the preferred embodiment of the invention and FIG. 2 illustrates the adjustment mechanism 1 of FIG. 1.

Referring to FIG. 1, track 2 supports rollers with adjustable suspension 3 which in turn support a door 4. The track 2 is divided into two segments, the pocket segment 6 illustrated on the left and the doorway segment 5 illustrated on the right. The two portions of the track are separated by a relief slit 9 in the track. The relief slit causes the track 2 to be somewhat flexible in the vicinity of the relief slit 9 which results in a hinge effect. The track pocket segment 6 of track 2 is within a pocket in a wall. The track doorway segment 5 of track 2 is above the door opening. Head member 7 provides support for the track 2. The track pocket segment 6 of track 2 is space away from but rigidly supported on the head member 7. This support is provided by screws (not shown) through the track pocket segment 6, a spacer 8 into head member 7. The spacer 8 separates the track pocket segment 6 from the head member 7 by approximately ¼ inch. The head member 7 is rigidly fastened into the wall opening in which the entire pocket door assembly is installed.

Track doorway segment 5 has two ends. The end at the relief slit 9 is referred to as the hinge end. The end illustrated on the right in FIG. 1 is referred to as the adjustment end.

Referring to FIG. 1, an adjustment assembly 1 appears at the right end, or adjustment end of the track doorway segment 5. This adjustment assembly 1 is illustrated in detail in FIG. 2. The adjustment assembly 1 provides a means of raising or lowering the adjustment end of the track doorway segment 5. When the adjustment end of the doorway segment 5 is adjusted up or down the track flexes slightly at the relief slit 9. Refer now to FIG. 2 for operation of the adjustment assembly 1. FIG. 2 shows a section through the track doorway segment 5 and the head member 7. Head member 7 is provided with a spring opening 12 into which a conical spring 11 has ben fitted. A threaded insert 13 is fitted into an opening 15 of the head member 7 concentric with the spring 11. A screw 10 passes through a hole 14 in the track doorway segment 5, through the center of the conical spring 11 into the threaded insert 13. The purpose of the spring is to urge the adjustment end of the track doorway segment into contact with the head of screw 10. The screw 10 is used to adjust the adjustment end of track doorway segment 5 up or down. Note that the spring would be unnecessary if the track is made of a material such as steel which could provide a spring effect at the relief slit 9. However the spring is used because it is common practice to make the track 2 of extruded aluminum which has very poor spring qualities.

Figure 3:
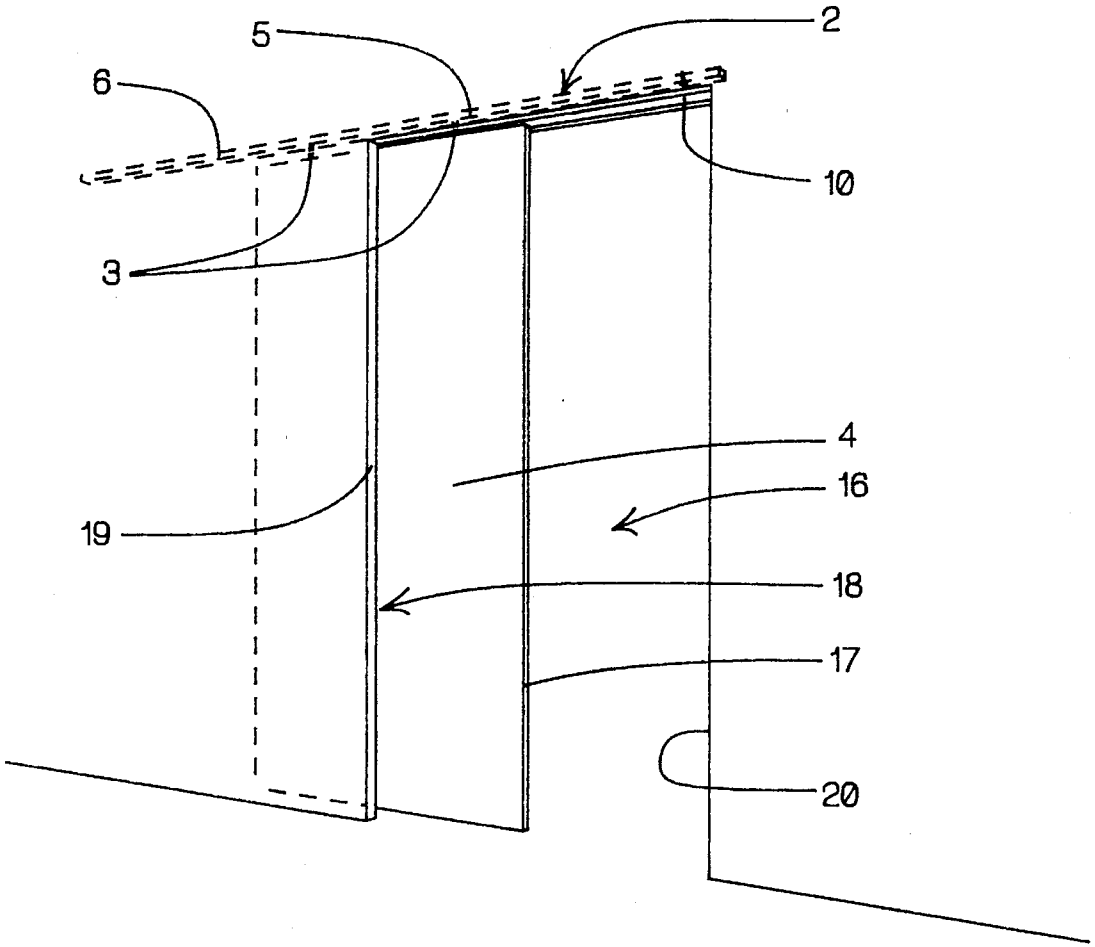
FIG. 3 illustrates a door pocket and door opening with a door hanging from an adjustable track.

Referring to FIG. 3, use of the invention is as follows. The adjustable track 2 is provided to the builder as part of a larger assembly referred to in the trade as a pocket door frame. This frame with the track 2 is installed in the customary manner by a framing crew. A trim out crew then installs casing (trim)(not shown) around the door opening 16. Prior to this invention, some trim carpenters installed the door on the track before trimming the door opening in order to check for proper alignment between the edge of the door and the sides of the door opening. This sequence is no longer necessary. Next the door 4 is installed on the roller assemblies which ride in the track 2. The suspension 3 of the door is then adjusted so that the edge 17 of the door 4 when in the pocket 18 properly aligns with the trimmed door opening 19 at the pocket 18. This process is the same as with conventional pocket doors and is familiar to installers, thus the process is not described here. The next step is to close the door and check the alignment of the door edge with the jamb 20. If upon closing the door the vertical edge 17 of the door does not meet the jamb uniformly top to bottom, the door is opened to make screw 10 accessible. The screw is adjusted so that when the door is again closed the edge of the door meets the jamb 20 properly. This adjustment process may have to be repeated several times to achieve perfect alignment.

Conclusions, Ramifications, and Scope

As the reader can see, this inventor has devised an effective mechanism for adjustment of pocket doors. In the appended claims an effort has been made to use word choices to cover the spirit of the invention. For example, the words "flexible hinge portion" are not to be interpreted as a literal hinge, but only to indicate an amount of flexibility necessary for proper operation of the invention. There is a possibility that a cleaver attempt to avoid infringement could avoid the strictest interpretation of the words chosen. Therefore the claims should be interpreted against the background of this specification and the spirit of the invention as set forth herein.

I claim:

1. A method of installing a pocket door assembly having a door pocket, a doorway opening and a door, said doorway opening having a pocket opening at said door pocket and a jamb on an opposite side of said doorway opening from said pocket opening, said door having a substantially vertical visible door edge, said method provides for adjusting said substantially vertical visible door edge to be parallel to said jamb when said door is positioned in said doorway opening independently of adjusting said substantially vertical visible door edge to be parallel to said pocket opening when said door is positioned inside said door pocket, said method comprising the following steps:

hanging said door by means of an adjustable suspension from a track comprised of a center flexible hinge portion between a pocket track segment and a door way track segment, said doorway track segment having a hinge end at said center flexible hinge portion and an adjustment end being the opposite end from said hinge end;

supporting rigidly said pocket track segment from a head member within said door pocket;

supporting said adjustment end of said doorway track segment by an adjustment means disposed between said adjustment end and said head member;

adjusting said adjustable suspension so that said door, when in said door pocket, hangs with said substantially vertical visible door edge parallel to said pocket opening;

adjusting said adjustment means so as to raise or lower said adjustment end of said doorway track segment so that said door, when in said doorway opening, hangs with said substantially vertical visible door edge parallel to said jamb.

* * * * *